US005269564A

United States Patent [19]

Arnt

[11] Patent Number: 5,269,564

[45] Date of Patent: Dec. 14, 1993

[54] GAME TAG HOLDER

[75] Inventor: Stanley L. Arnt, Watervliet, Mich.

[73] Assignee: Michigan Outdoor Products, Inc., Watervliet, Mich.

[21] Appl. No.: 972,244

[22] Filed: Nov. 5, 1992

[51] Int. Cl.[5] ..... B42D 15/00

[52] U.S. Cl. ..... 283/104; 40/1.6; 40/300; 283/100

[58] Field of Search ..... 40/1.6, 5, 6, 300, 301, 40/302; 283/100, 104, 103

[56] References Cited

U.S. PATENT DOCUMENTS

| | | | |
|---|---|---|---|
| 861,881 | 7/1907 | Nixon | 283/104 |
| 891,593 | 6/1908 | Conrad et al. | 283/103 X |
| 1,229,176 | 6/1917 | Feddern | 283/104 X |
| 1,871,597 | 8/1932 | English | 283/100 X |
| 1,910,218 | 5/1933 | Hetrick . | |
| 1,951,596 | 3/1934 | Creesy | 283/104 X |
| 2,548,104 | 4/1951 | Frison | 40/1.6 |
| 2,821,035 | 1/1958 | Joseph | 40/10 |
| 2,833,064 | 5/1958 | Parker | 283/100 X |
| 3,160,155 | 12/1964 | Bragg et al. | 40/300 X |

*Primary Examiner*—Paul A. Bell

*Attorney, Agent, or Firm*—Flynn, Thiel, Boutell & Tanis

[57] ABSTRACT

A combination game tag holder and game kill tag, the game kill tag having printed information in segments along at least one marginal edge thereof, selected segments of the printed information being adapted to be removed following a game kill. The game tag holder has first and second parallel and transparent sheets conforming in dimension to the game kill tag and closely spaced from one another to contain the game kill tag therebetween. The transparent sheets are made of a material that is more resistant to cutting than the game kill tag. Plural and separate notches are provided in at least one marginal edge of the game tag holder, the notches and segmented printed information being aligned when the game kill tag is between the aforesaid sheets so that the segmented printed information is exposed through the notches. Exposed edges of the notches each define a guide surface for a cutting implement to facilitate a guided cutting and removal of only the selected segments of the printed information from the game kill tag.

8 Claims, 1 Drawing Sheet

GAME TAG HOLDER

FIELD OF THE INVENTION

This invention relates to a combination of a game tag holder and a game kill tag and, more particularly, to a game tag holder having plural notches on at least one edge for guiding a cutting implement for the purpose of cutting a notch into an edge of the game kill tag.

BACKGROUND OF THE INVENTION

The issuance of licenses for hunting game usually includes not only a license issued to the individual concerned, but also a game kill tag which is to be attached to the carcass of the animal, such as a deer, after the hunter has made the kill. It is usually customary for the hunter to mark the game kill tag to indicate the sex of the animal, the month and day of the kill and/or the number of points on the antlers on the animal, if the animal is a deer. Usually, the game kill tag has printed information along the marginal edges to indicate where the game kill tag is to be marked to indicate the aforesaid information. The hunter usually takes an instrument, such as a knife, or some other form of cutting implement to cut into the marginal edge of the game kill tag whereat printed indicia appears to indicate the aforesaid information concerning the animal that has been killed. The hunter thereafter customarily is required to file a report on the kill with the Department of Natural Resources, or equivalent authority, so that an appropriate record can be maintained of the number of animals of various types killed during the hunting season.

Since the rules and regulations controlling hunting require the hunter to immediately tag the animal that has been killed, the hunter must make the appropriate marking on the game kill tag before the game kill tag is attached to the carcass of the animal that has been killed. Under most circumstances, marking the game kill tag has been difficult since a very sharp cutting implement is usually required to cut into the edge of the water resistant but yet crushable game kill tag. If the cutting implement is not extremely sharp, it is difficult to mark the game kill tag utilizing a cutting implement. When a cutting is effected, in some instances, the game kill tag is inadvertently, accidentally, cut nearly in half due to the lack of any guide being provided for stopping the cutting implement once a cutting task has been started. Thus, neat and cleanly cut and marked game kill tags have been difficult to generate.

Accordingly, it is an object of this invention to provide a combination game tag holder and a game kill tag wherein the game tag holder is comprised of transparent sheets having the game kill tag oriented therebetween with the transparent sheets being more resistant to cutting than the game kill tag, the game tag holder having plural notches in at least one marginal edge thereof so as to expose edges of the game kill tag, the edges of the notches providing a guide surface for a cutting implement to facilitate a guided cutting and removal of selected segments of the printed information on the guide kill tag.

It is a further object of the invention to provide a combination game tag holder and game kill tag, as aforesaid, wherein the game tag holder is comprised of transparent sheets secured along marginal edges thereof to define an envelope into which can be inserted the game kill tag.

It is a further object of the invention to provide a combination game tag holder and game kill tag as aforesaid, wherein a flap is provided on one of the transparent parent sheets for effecting a closing of the envelope to prevent removal of the game kill tag once the flap has been closed.

It is a further object of the invention to provide a combination game tag holder and game kill tag wherein the transparent sheets each have a hole therein which is axially aligned with the other and wherein the flap also includes a hole alignable with the aforementioned holes so that an elongated strand can be received in the aligned holes to effect securement of the game tag holder and game kill tag to the carcass of an animal that has been killed.

SUMMARY OF THE INVENTION

The objects and purposes of the invention have been met by providing a combination game tag holder and game kill tag, the game kill tag having printed information in segments along at least one marginal edge thereof, selected segments of the printed information being adapted to be removed following a game kill. The game tag holder has first and second parallel and transparent sheets conforming in dimension to the game kill tag and closely spaced from one another to contain the game kill tag therebetween. The transparent sheets are made of a material that is more resistant to cutting than the game kill tag. Plural and separate notches are provided in at least one marginal edge of the game tag holder, the notches and segmented printed information being aligned when the game kill tag is between the aforesaid sheets so that the segmented printed information is exposed through the notches. Exposed edges of the notches each define a guide surface for a cutting implement to facilitate a guided cutting and removal of only the selected segments of the printed information from the game kill tag.

BRIEF DESCRIPTION OF THE DRAWINGS

Other objects and purposes of this invention will be apparent to those of ordinary skill in the art upon reading the following specification with reference to the accompanying drawings, in which.

DETAILED DESCRIPTION

Figure 1:
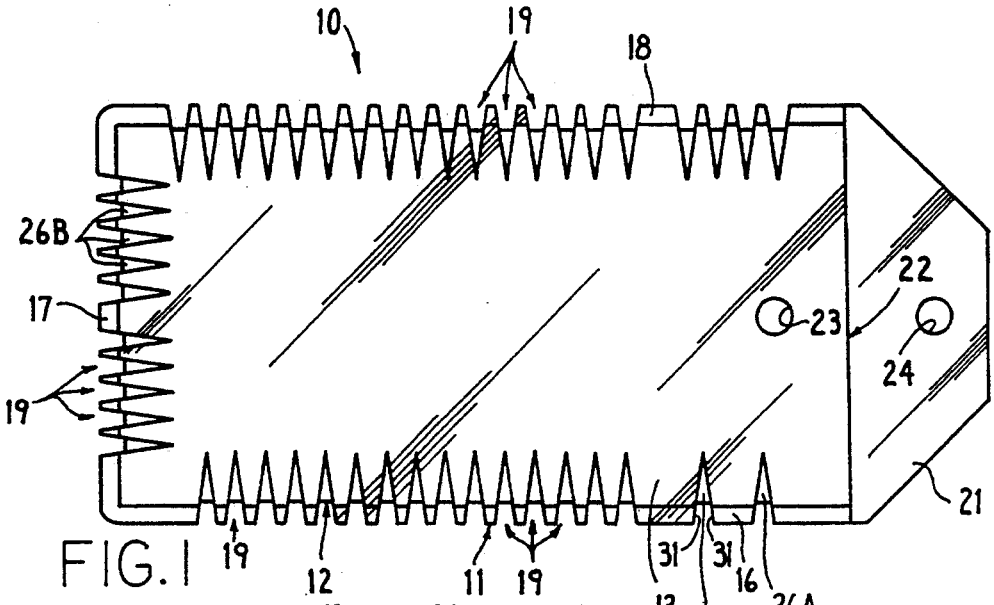
FIG. 1 is a front elevational view of a game tag holder embodying the invention.
Figure 2:
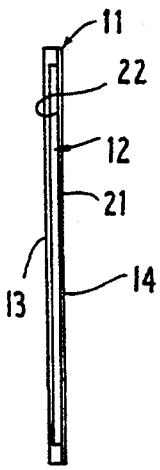
FIG. 2 is a right end view of FIG. 1.
Figure 3:
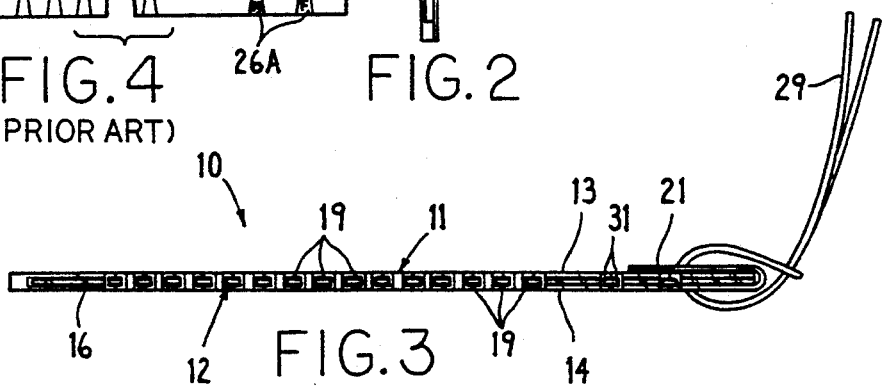
FIG. 3 is an edge view of the game tag holder having a game kill tag housed therein.

A combination 10 of a game tag holder 11 and a game kill tag 12 is illustrated in FIGS. 1, 2 and 3. The game tag holder 11 includes a pair of rectangularly shaped, parallel transparent plastic sheets 13 and 14 that are secured to one another along three marginal edges as schematically illustrated at 16, 17 and 18. This form of securement can be by welding the two sheets together at the aforesaid three marginal edges to define an envelope-like structure. In this particular embodiment, each edge of the holder 11 has a plurality of separate notches 19 therein. It is to be recognized that it is within the scope of this invention to provide the plural notches on only one marginal edge. Each of the notches 19 preferably has a V-shape and, in this particular embodiment, each notch is identical to the others. Further, some of the notches are spaced further apart from the next mutually adjacent notch, this being for the purpose of facilitating an alignment of the notches with information on the kill tag 12 which will be described below.

In this particular embodiment, one of the sheets, here the sheet 14, has an end flap 21 integrally formed thereon. As illustrated in FIG. 2 a spacing exists between the sheets 13 and 14 so as to define an opening 22 therebetween adjacent the end flap 21. The game kill tag 12 is to be inserted into the opening 22 between the transparent sheets 13 and 14. The sheets 13 and 14 each have a hole 23 therein which is axially aligned with the other. The end flap 21 also has a hole 24 therethrough and is spaced an appropriate distance from a fold line for the end sheet 21 so as to cause the holes 23 and 24 to become axially aligned when the flap is folded over, as illustrated in FIG. 3, to a position wherein it becomes parallel to and overlapped with the outer surface of the transparent sheet 13. A closing of the flap 21 as illustrated in FIG. 3 prevents the game kill tag 12 from being capable of being removed from between the transparent sheets 13 and 14.

Figure 4:
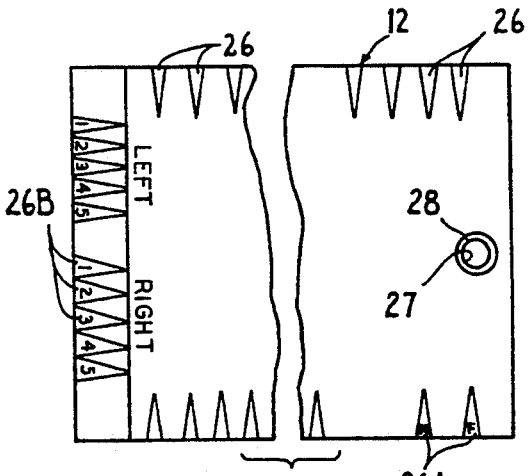
FIG. 4 (PRIOR ART)
FIG. 4 is a front view of a known game kill tag having printed information in segments along the marginal edges thereof.

The known game kill tag 12 illustrated in FIG. 4 is generally of a rectangular shape and is preferably made of a coated paper material that renders the game kill tag water repellent. In this particular embodiment, the material of the game kill tag 12 is more susceptible to being cut by a cutting implement than is the material of the transparent sheets Printed information is provided in plural segments 26 at various locations along the three marginal edges of the tag 12. Instructions provided on the game kill tag will indicate to the hunter what each segment is intended to designate to the Department of Natural Resources or equivalent authority. For example, the notches 26A can designate whether the animal killed is either male (M) or female (F) and the "M" and "F" designations can be printed in the segments as illustrated at 26A in FIG. 4. Other segments may each contain a number such as is shown at 26B in FIG. 4 to designate the number of points on either the left or right antler, if the animal killed is a deer. Other arrangement of the printed information on the game kill tag can be present for purposes designated by the Department of Natural Resources or equivalent authority. The game kill tag 12 has a hole 27 therethrough which is ringed by a metal grommet 28.

The combination 10 includes the insertion of the game kill tag 12 into the opening 22 in the game tag holder 11 so that the printed information in the respective segments 26 will be accessible through the plural notches 19. Thereafter, the flap 21 can be closed as illustrated in FIG. 3 and an appropriate cord 29 can be looped through the now aligned holes 23 and 24 to facilitate securement of the game tag holder with the game kill tag therein to the carcass of an animal that has been killed. When an animal has been killed, such as a deer, the appropriate sex of the animal can be marked at 26A by guiding a sharp knife blade, for example, along the opposing guide surface 31 of the exposed edges of the appropriate notch 19, the sharp cutting edge of the knife blade moving toward the apex of the V-shaped notch to effect a severing and, therefore, enabling a removal of a V-shaped segment from the game kill tag 12. Since the sheets 13 and 14 of the game tag holder 11 are preferably somewhat rigid and, therefore, much more resistant to cutting than is the material of the game kill tag 12, the guide surfaces 31 will effectively permit the removal of the appropriate segments on the game kill tag 12 to properly mark the carcass.

In this particular embodiment, the plastic transparent sheets have a thickness in the range of 0.2 to 0.8 mm.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. The combination of a game tag holder and a game kill tag, said game kill tag being generally rectangular in shape and having printed information in segments along at least one marginal edge thereof, selected segments of said printed information being adapted to be removed following a game kill, said game tag holder comprising first and second parallel, rectangular, transparent sheets conforming in dimension to said game kill tag and closely spaced to contain said game kill tag therebetween, said first and second sheets being more resistant to cutting than said game kill tag, means defining plural and separate notches in at least one marginal edge of said holder, said notches and said segmented printed information being aligned when said game kill tag is inside of said holder so that said segmented printed information is exposed through said notches, exposed edges of said notches each defining a guide surface for a cutting implement to facilitate a guided cutting and removal of only said selected segments of said printed information from said game kill tag.

2. The combination according to claim 1, wherein said first and second sheets are permanently secured to each other along at least three marginal edges, said game kill tag being inserted between said first and second sheets at a fourth marginal edge.

3. The combination according to claim 2, including securing means for securing said game tag holder to a carcass of a killed animal.

4. The combination according to claim 2, wherein said game tag holder includes a flap secured to said first sheet at said fourth marginal edge, said flap having a sufficient dimension to enable it to fold over so as to become parallel to and be overlapped with said second sheet to effect a closing of said fourth edge to prevent a removal of said game kill tag.

5. The combination according to claim 4, wherein said first and second sheets each have first means defining a first hole therethrough, said first holes being axially aligned, wherein said flap includes second means defining a second hole therethrough, said first and second holes being axially aligned when said flap is parallel to and overlapped with said second sheet, and wherein said securing means is an elongated strand received in said aligned first and second holes.

6. The combination according to claim 2, wherein two of said three marginal edges includes said means defining plural and separate notches, said game kill tag having said selected segments of said printed information on two of said edges thereof alignable with said notches so that said segmented printed information becomes exposed through said notches.

7. The combination according to claim 1, wherein three of said three marginal edges includes said means defining plural and separate notches, said game kill tag having said selected segments of said printed information on three of said edges thereof alignable with said notches so that said segmented printed information becomes exposed through said notches.

8. The combination according to claim 1, wherein said notches are V-shaped.

* * * * *